US009173474B2

(12) United States Patent
Winterburg

(10) Patent No.: US 9,173,474 B2
(45) Date of Patent: Nov. 3, 2015

(54) ID CARD HOLDER

(76) Inventor: Chadd Steven Winterburg, Radcliff, KY (US)

( * ) Notice: Subject to any disclaimer, the term of this patent is extended or adjusted under 35 U.S.C. 154(b) by 91 days.

(21) Appl. No.: 13/532,930

(22) Filed: Jun. 26, 2012

(65) Prior Publication Data

US 2013/0340901 A1 Dec. 26, 2013

(51) Int. Cl.

| | |
|---|---|
| ***B65D 85/00*** | (2006.01) |
| ***A45F 5/00*** | (2006.01) |
| ***A45C 11/18*** | (2006.01) |

(52) U.S. Cl.

CPC ..... *A45F 5/00* (2013.01); *A45C 11/182* (2013.01); *A45F 2005/006* (2013.01); *A45F 2200/055* (2013.01)

(58) Field of Classification Search

USPC ..... 150/149, 131, 147, 134; 206/38, 39, 37; 224/604, 603, 587; 40/776, 661, 40/654.01, 651; D3/247

See application file for complete search history.

(56) References Cited

U.S. PATENT DOCUMENTS

| | | | | | |
|---|---|---|---|---|---|
| 2,968,109 | A | * | 1/1961 | Timmins | 40/763 |
| 4,113,098 | A | * | 9/1978 | Howard | 206/540 |
| 4,202,445 | A | * | 5/1980 | Porter | 206/37 |
| 4,774,779 | A | * | 10/1988 | Ackeret | 40/721 |
| 5,125,505 | A | * | 6/1992 | Kurosaki | 206/39.4 |
| 5,285,897 | A | * | 2/1994 | Ozaki | 206/387.12 |
| 5,384,972 | A | * | 1/1995 | Arnt | 40/1.6 |
| D386,302 | S | * | 11/1997 | Taylor | D3/247 |
| 2002/0056652 | A1 | * | 5/2002 | Kawamura et al. | 206/37 |
| 2003/0093931 | A1 | * | 5/2003 | Cuff | 40/1.6 |
| 2008/0056652 | A1 | * | 3/2008 | Nothofer et al. | 385/113 |

* cited by examiner

*Primary Examiner* — Fenn Mathew
*Assistant Examiner* — Cynthia Collado
(74) *Attorney, Agent, or Firm* — James M. Smedley LLC; James Michael Smedley, Esq.

(57) ABSTRACT

The present invention generally relates to identification card holders. In particular, embodiments of the invention are directed to an apparatus for retaining an identification card ("ID card") in a manner that allows for the card to be swiped or otherwise utilized without requiring the ID card from being removed from the ID card holder.

11 Claims, 5 Drawing Sheets

ID CARD HOLDER

FIELD OF THE INVENTION

The present invention generally relates to identification card holders. In particular, embodiments of the invention are directed to an apparatus for retaining an identification card ("ID card") in a manner that allows for the card to be swiped or otherwise utilized without requiring the ID card from being removed from the ID card holder.

BACKGROUND

Use of identification badges and cards is ubiquitous in modern society. From providing access to restricted areas to identifying one or more privileges of the respective card holder, the usage scenarios and implementations are nearly endless.

However, given the scope of use of these identification badges and cards (collectively, "ID cards"), ease of use has rarely been a concern. Most ID cards are rectangular cards with one or more identification elements where the identification elements are designed to verify the card holder and provide access to some defined set of privileges. Commonly, identification elements include photographs of the card holder, identification information (e.g., name, address, height, weight, gender, eye color, hair color, ethnicity), one or more readable elements or some combination thereof. The readable elements of the ID card are frequently magnetic strips or other machine readable component that, when engaged with a reader component, functions to identify the user to a related system (e.g., a computer attached to the reader component).

In practice, most individuals store their ID cards in a wallet, card holder or other container that is used to secure the ID card while the ID card is not needed. When the ID card is needed, the individual will retrieve the ID card from the container and swipe or otherwise provide the ID card to the reader component or individual reviewing the ID card. This requires the user to spend time accessing the container and retrieving the ID card therefrom.

Some ID cards have built in means for allowing a wearable attachment to be connected to the ID card. These ID cards are convenient in that a user may wear the ID card without requiring a container or other means for carrying the ID card. However, not all ID cards have built in means for allowing a wearable attachment to be connected. Further, many ID cards currently utilized contain sophisticated electronic components (e.g., magnetic strips, computer chips, near field communication (NFC) components) that may be damaged if an individual attempted to add their own wearable attachment means to the ID card. Not to mention that may organizations would consider tampered ID cards as invalid or otherwise compromised.

Unfortunately, this means that ID card holders that are required to carry ID cards without wearable attachment means built-in are forced to utilize containers that require the user retrieve the card from the container each time the ID card holder is required to present or swipe their ID card.

Therefore, there is need in the art for an ID card holder that allows for the identification card to be retained in a manner that allows the ID card to be read without requiring the ID card to be removed from the ID card holder. These and other features and advantages of the present invention will be explained and will become obvious to one skilled in the art through the summary of the invention that follows.

SUMMARY OF THE INVENTION

Accordingly, it is an aspect of the present invention to provide an ID card holder that allows for the identification card to be retained in a manner that allows the ID card to be read without requiring the ID card to be removed from the ID card holder.

According to an embodiment of the present invention, an ID card holder configured to retain an identification card includes: a first ID card receptacle component, comprising a body with a slot configured to receive an identification card and a first connection means; a second ID card receptacle component, comprising a body configured to receive the first ID card receptacle component therein and a second connection means, wherein said identification card is secured in the slot of first ID card receptacle component when the first ID card receptacle component is received in the second ID card receptacle component, and wherein the first connection means and the second connection means engage together to form a releasable lock to hold the first ID card receptacle component and the second ID card receptacle component together.

According to an embodiment of the present invention, the ID card holder allows a readable component of the identification card to be read without removing the identification card from the ID card holder.

According to an embodiment of the present invention, the ID card holder allows said identification card to be swiped in an identification card reader without removing said identification card from said ID card holder.

According to an embodiment of the present invention, the ID card holder further includes a wearable attachment component attachment means connected to the second ID card receptacle component.

According to an embodiment of the present invention, the wearable attachment component comprises a hole for receiving a wearable component.

According to an embodiment of the present invention, the wearable component is one or more of a necklace, a bracelet, a lanyard, a retractable cord, a belt clip and a wallet clip.

According to an embodiment of the present invention, the ID card holder is comprised of one or more materials consisting of rubber, plastic, metal, ceramics and silicone.

According to an embodiment of the present invention, the identification card is secured in the slot of said first ID card receptacle component by way of a friction fit.

According to an embodiment of the present invention, the first connection means is a tab lock and said second connection means is a complimentary tab lock.

According to an embodiment of the present invention, the first connection means and second connection means secure together in a friction fit.

According to an embodiment of the present invention, the first connection means and second connection means secure together in a spring biased tension lock.

According to an embodiment of the present invention, the first connection means and the second connection means are circular.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
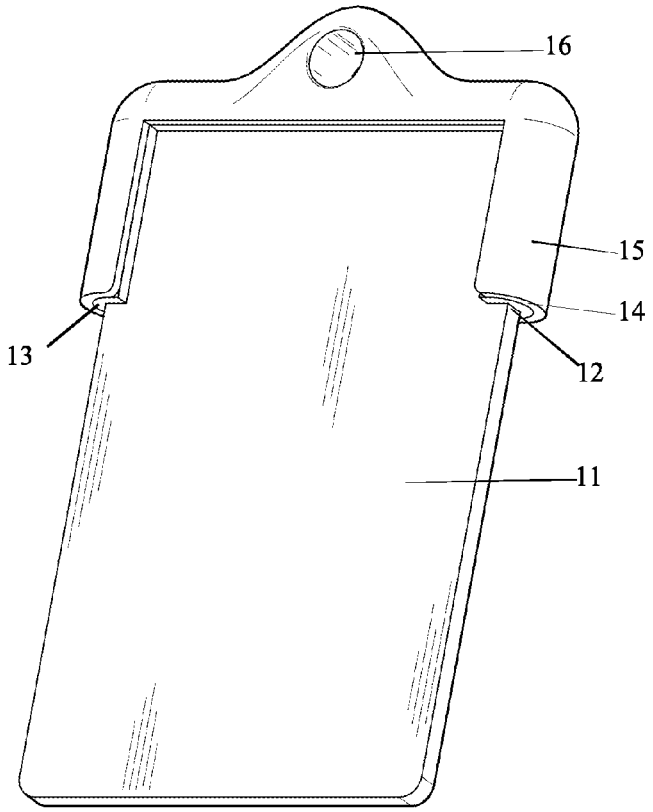
FIG. 1 illustrates a front perspective view of an ID card holder, in accordance with an embodiment of the present invention.

The present invention generally relates to identification card holders. In particular, embodiments of the invention are directed to an apparatus for retaining an identification card ("ID card") in a manner that allows for the card to be swiped or otherwise utilized without requiring the ID card from being removed from the ID card holder.

According to an embodiment of the present invention, the ID card holder of includes a first ID card receptacle component, a second ID card receptacle component, and a wearable attachment component.

In accordance with an embodiment of the present invention, the first ID card receptacle component is comprised of a body with a slot configured to receive an identification card and a first connection means. In a preferred embodiment, the body forms a substantially u-shaped configuration and the slot is formed as a channel running along an inside wall of the body. In this preferred embodiment, the slot is configured to receive three sides of a rectangular ID card, with the fourth side of the rectangular ID card left exposed so that the ID card may be swiped or otherwise engage with a reader component configured to read or access information stored on the ID card.

In certain embodiments, the slot may be further comprised of a high-friction material, such as rubber or silicone. In these embodiments, the high-friction materials works to assist with the retention of the ID card within the slot as well as reduce damage/wear-and-tear to the ID card that may otherwise be caused by extended use.

In accordance with an embodiment of the present invention, the second ID card receptacle component is comprised a body configured to receive the first ID card receptacle component therein and a second connection means. The body of the second ID card receptacle component is configured to be large enough to allow the body of the first ID card receptacle component to be received within a slot formed as a channel running along the inside wall of the second ID card receptacle component body.

According to an embodiment of the present invention, a friction fit is formed when the first ID card receptacle component is inserted into the slot of the second ID card receptacle component. The resulting friction fit applies additional pressure to the ID card stored in the slot of the first ID card receptacle component in such a manner that the ID card is securely fastened in the slot of the first ID card receptacle component. In this manner, the ID card is safely secured in the slot of the first ID card receptacle component until the first ID card receptacle component is removed from the slot of the second ID card receptacle component.

According to an embodiment of the present invention, with respect to the first connection means and second connection means, the first connection means and second connection means are configured to work together, when the first ID card receptacle component and second ID card receptacle component are secured together. When joined, the first connection means and second connection means form a locking component that will stay locked until an individual takes an action to release the formed locking component. The first connection means and second connection means may be one or more of a spring biased connection means, a hook and loop connection means, a friction fit connection means, a twist and lock connection means and a tabbed connection means. One of ordinary skill in the art would appreciate that there are numerous types of connection means that could be utilized with embodiments of the present invention and embodiments of the present invention are contemplated for use with any type of connection means.

According to an embodiment of the present invention, the wearable attachment component is attached to one of the first ID card receptacle component or the second ID card receptacle component. In a preferred embodiment, the wearable attachment component is attached to the second ID card receptacle component. The wearable attachment component is configured to receive one or more wearable components that allow an individual to wear the apparatus. For instance, the wearable component may include, but is not limited to, a bracelet, a necklace, a lanyard, a belt clip, a retractable cord apparatus, or any combination thereof. One of ordinary skill in the art would appreciate that there are numerous wearable components that may be utilized with the wearable attachment component of embodiments of the present invention, and embodiments of the present invention are contemplated for use with any type of wearable component.

In a preferred embodiment, the wearable attachment component is a hole received through the body of the second ID card receptacle component. In this embodiment, the wearable component is attached through the hole and/or secured thereto. In other embodiments, the wearable attachment component could include, but is not limited to, hook and loop fasteners, an adhesives, a clip and a magnetic attachment means. One of ordinary skill in the art would appreciate that there are numerous types of wearable attachment components that may be utilized with embodiments of the present invention, and embodiments of the present invention are contemplated for use with any type of wearable attachment components.

According to an embodiment of the present invention, the ID card holder may be constructed from durable materials that suit the intended purpose of the ID card holder and potential the ID card itself. For instance, embodiments of the present invention may be comprised of rubber, plastic, silicone, ceramics, metals, other durable materials or any combination thereof. However, where there are applications of the ID card that have certain characteristics (e.g., a magnetic strip), suitable ID card holders will be comprised of materials that do not interfere with these characteristics (e.g., ferromagnetic materials).

In practice, since preferred embodiments of the present invention are constructed in a manner as to not impede the utilization of the ID card held in the apparatus, the ID card may be utilized without requiring the removal of the ID card from the apparatus. For example, the ID card holder apparatus may form a U-Shape around an ID card that is designed to be swiped through a reader component. In this form, the U-Shape ID Card holder apparatus is configured in such a manner as not to impede the swiping of the ID card through the reader component.

Exemplary Embodiments

Turning now to FIG. 1, a front perspective view of an ID card holder, in accordance with an embodiment of the present invention, is shown. In this embodiment as shown, an ID card 11 is stored inside the slot 12 of the first ID card receptacle component 13 which is in turn locked into the slot 14 of the second ID card receptacle component 15. Also in this embodiment, the second ID card receptacle component 15 is further comprised of a wearable attachment component 16.

Figure 2:
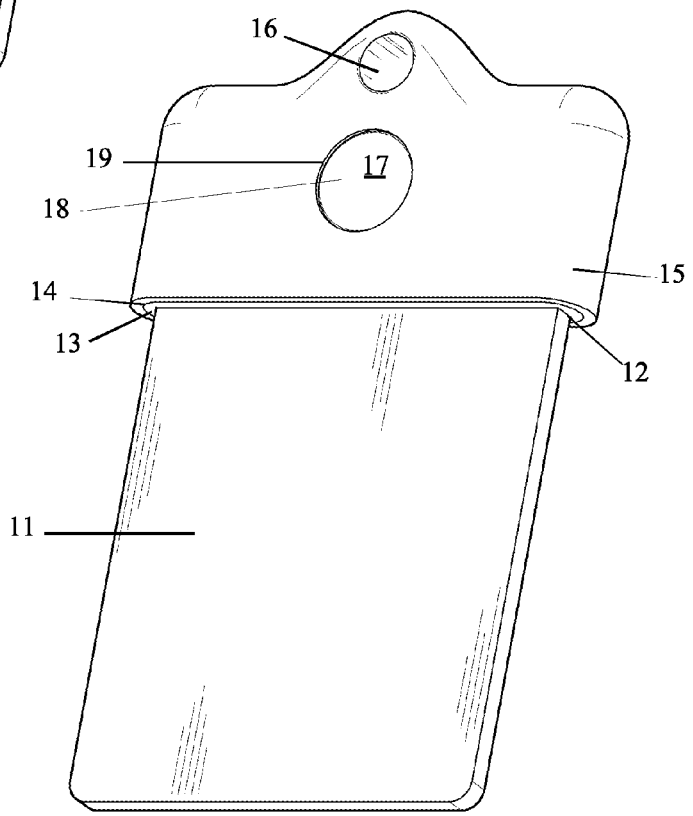
FIG. 2 illustrates a rear perspective view of an ID card holder, in accordance with an embodiment of the present invention.

Turning now to FIG. 2, a rear perspective view of an ID card holder, in accordance with an embodiment of the present invention, is shown. In this embodiment as shown, an ID card 11 is stored inside the slot 12 of the first ID card receptacle component 13 which is in turn locked into the slot 14 of the second ID card receptacle component 15. Also in this embodiment, the second ID card receptacle component 15 is further comprised of a wearable attachment component 16. Further, in FIG. 2, the locking component 17 is shown, formed between the first connection means 18 of the first ID card receptacle component 13 and the second connection means 19 of the second ID card receptacle component 15.

Figure 3:
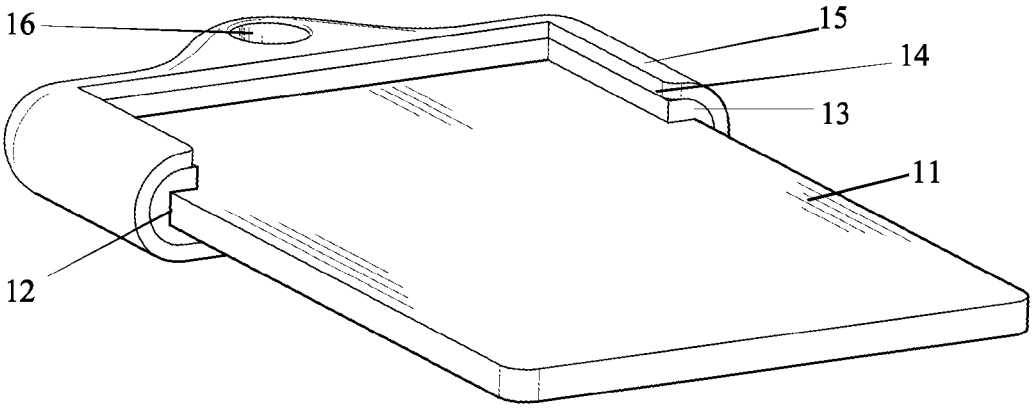
FIG. 3 illustrates a side perspective view of an ID card holder, in accordance with an embodiment of the present invention.

Turning now to FIG. 3, a side perspective view of an ID card holder, in accordance with an embodiment of the present invention, is shown. In this embodiment as shown, an ID card 11 is stored inside the slot 12 of the first ID card receptacle component 13 which is in turn locked into the slot 14 of the second ID card receptacle component 15. Also in this embodiment, the second ID card receptacle component 15 is further comprised of a wearable attachment component 16.

Figure 4:
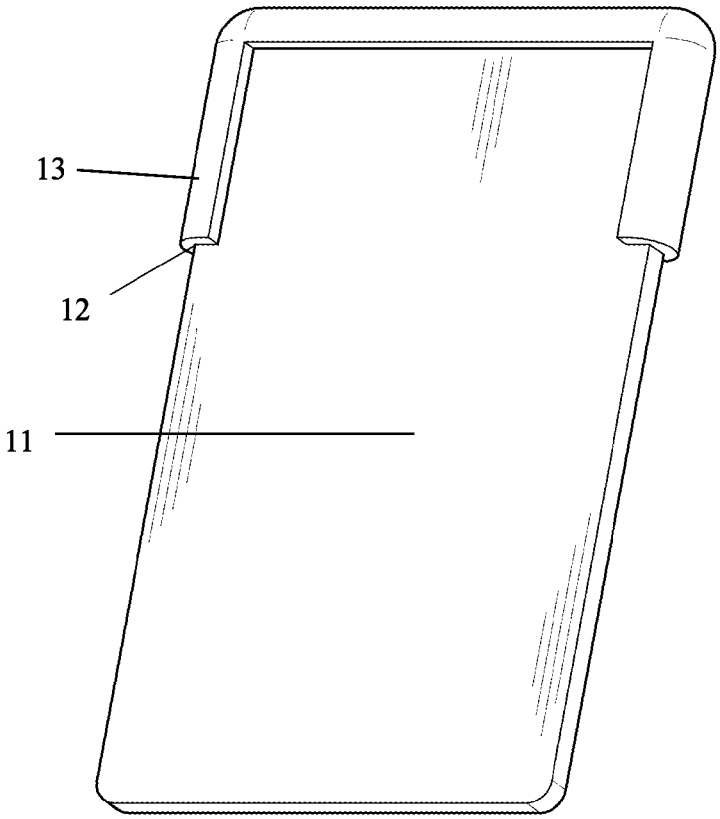
FIG. 4 illustrates a front perspective view of an ID card holder, in accordance with an embodiment of the present invention.

Turning now to FIG. 4, a front perspective view of a first ID card receptacle component, in accordance with an embodiment of the present invention, is shown. In this embodiment as shown, an ID card 11 is stored inside the slot 12 of the first ID card receptacle component 13. As shown, the U-shaped walls form a three-sided slot around the ID card 11.

Figure 5:
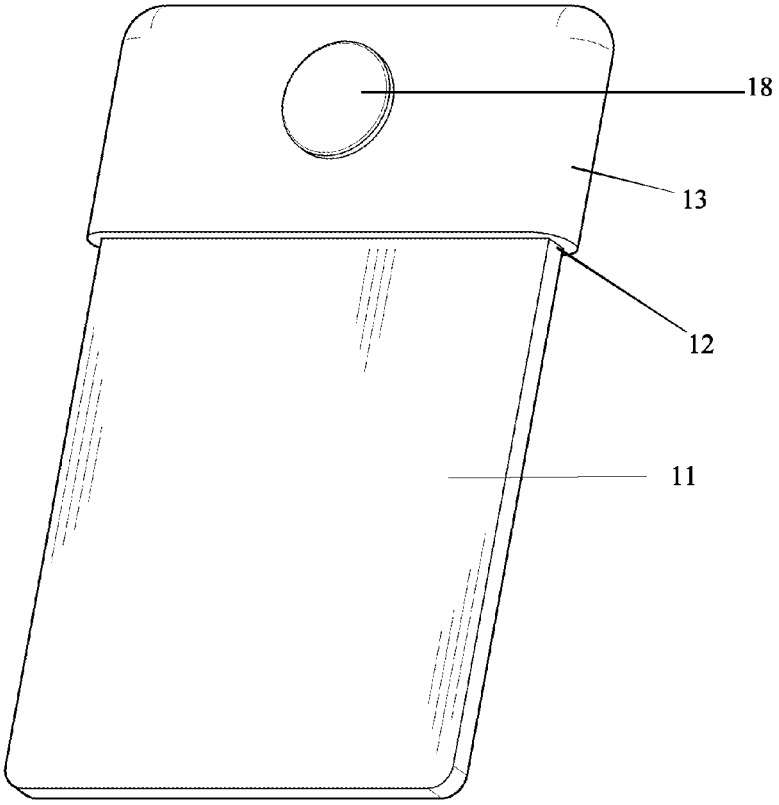
FIG. 5 illustrates a rear perspective view of an ID card holder, in accordance with an embodiment of the present invention.

Turning now to FIG. 5, a rear perspective view of a first ID card receptacle component, in accordance with an embodiment of the present invention, is shown. In this embodiment as shown, an ID card 11 is stored inside the slot 12 of the first ID card receptacle component 13. Further, a first connection means 18 is shown.

Figure 6:
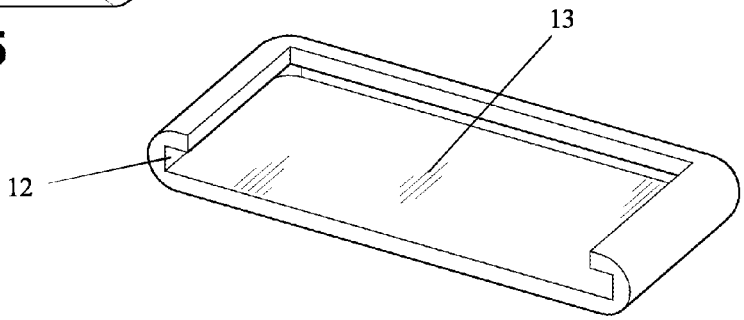
FIG. 6 illustrates a front perspective view of an ID card holder, in accordance with an embodiment of the present invention.

Turning now to FIG. 6, a front perspective view of a first ID card receptacle component, in accordance with an embodiment of the present invention, is shown. In this embodiment as shown, the slot 12 of the first ID card receptacle component 13 is empty, showing the channel formed between the U-shaped walls of the first ID card receptacle component 13.

Figure 7:
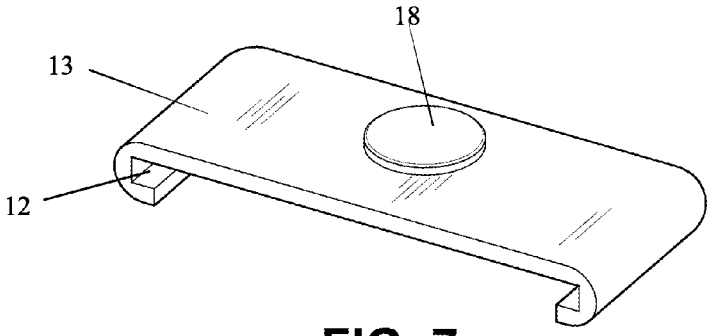
FIG. 7 illustrates a front perspective view of an ID card holder, in accordance with an embodiment of the present invention.

Turning now to FIG. 7, a rear perspective view of a first ID card receptacle component, in accordance with an embodiment of the present invention, is shown. In this embodiment as shown, the slot 12 of the first ID card receptacle component 13 is empty, showing the channel formed between the U-shaped walls of the first ID card receptacle component 13. Further, this FIG. 7 shows the first connection means 18.

Figure 8:
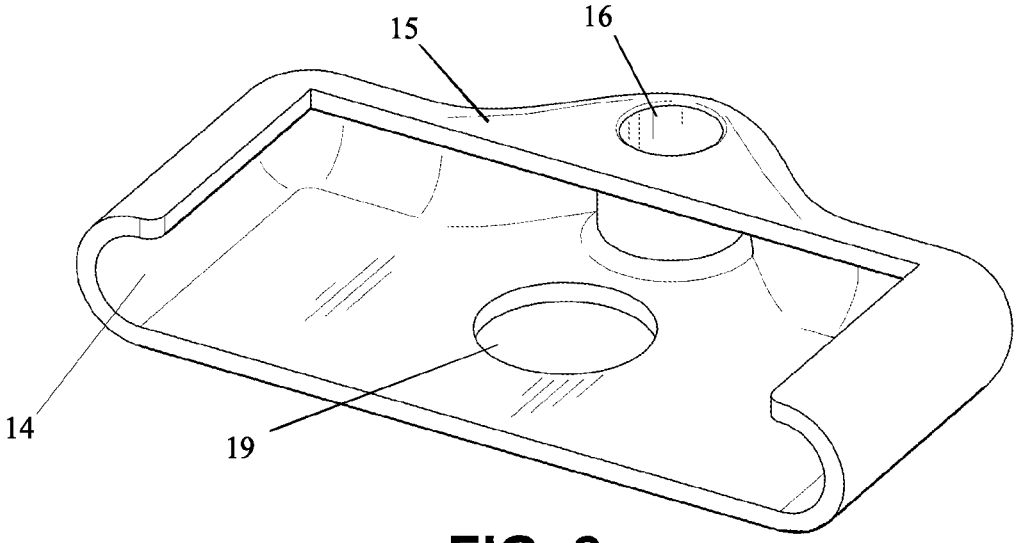
FIG. 8 illustrates a top perspective view of an ID card holder, in accordance with an embodiment of the present invention.

Turning now to FIG. 8, a top perspective view of a second ID card receptacle component, in accordance with an embodiment of the present invention, is shown. In this embodiment as shown, the slot 14 of the second ID card receptacle component 15 is empty, showing the channel formed between the U-shaped walls of the second ID card receptacle component 15. Also in this embodiment, the second ID card receptacle component 15 is further comprised of a wearable attachment component 16 and the second connection means 19.

Figure 9:
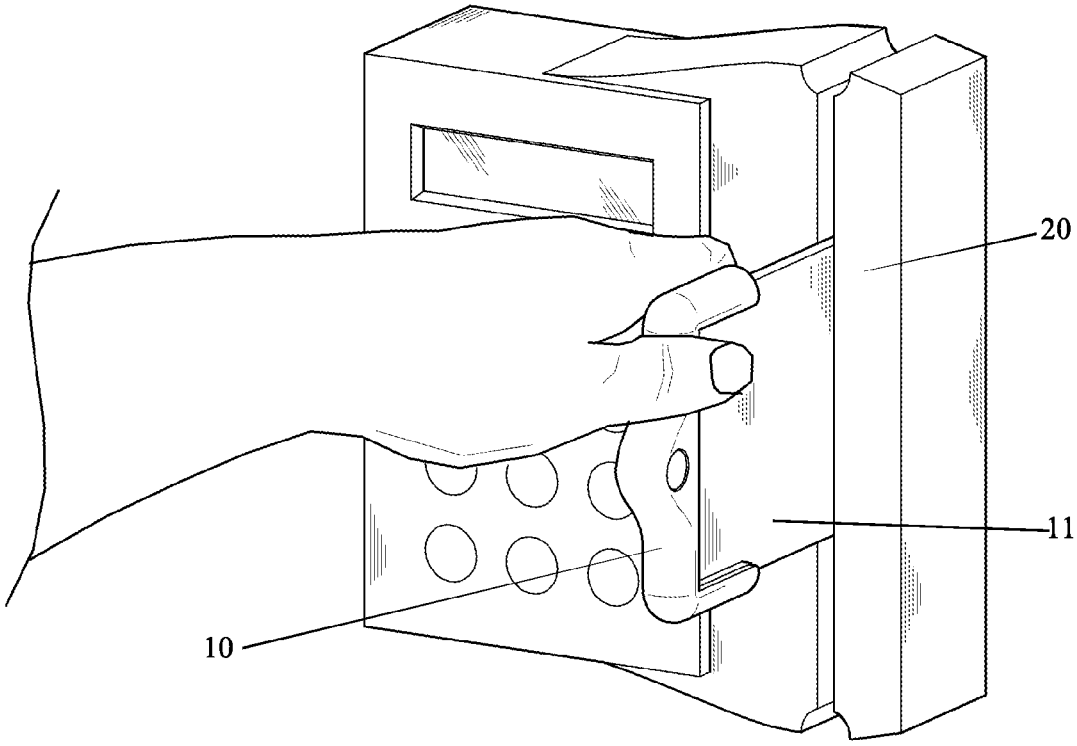
FIG. 9 illustrates an ID card holder in utilization, in accordance with an embodiment of the present invention.

Turning now to FIG. 9, an ID card holder in utilization, in accordance with an embodiment of the present invention, is shown. In this illustration, the ID card 11 is held in the ID card holder 10. Further in this illustration, the entire apparatus and the ID card 11 is being swiped through a reader component 20. As shown, the individual has no need to remove the ID card 11 from the ID card holder 10 to utilize the ID card 11 with the reader component 20.

Figure 10:
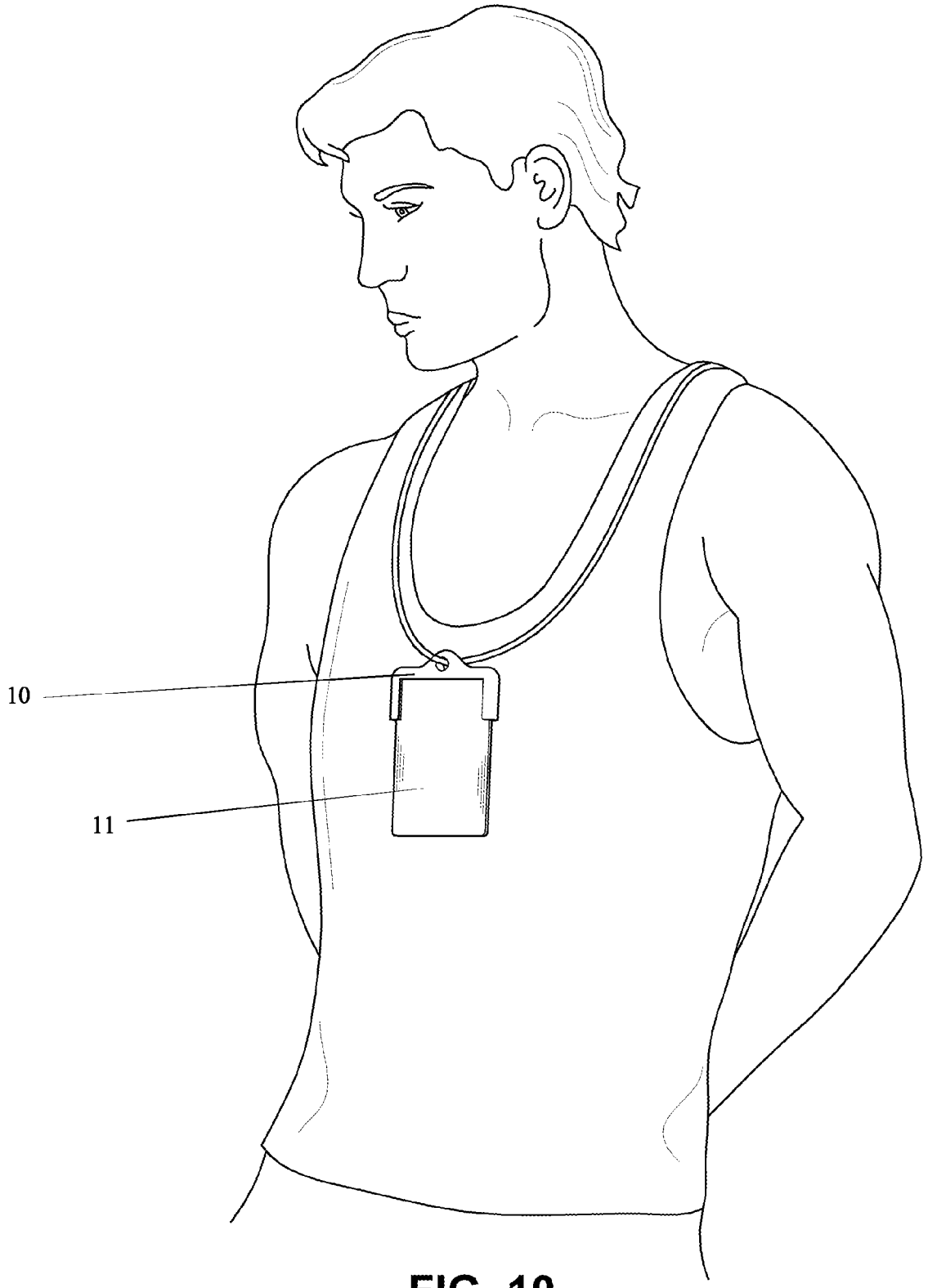
FIG. 10 illustrates an ID card holder in utilization, in accordance with an embodiment of the present invention.

Turning now to FIG. 10, an ID card holder in utilization, in accordance with an embodiment of the present invention, is shown. In this illustration, the ID card holder 10 is being worn by an individual with a ID card 11 retained within the ID card holder 11.

While the figures of this application and much of the description of this application reference a u-shaped ID card holder for use with rectangular ID cards, one of ordinary skill in the art would appreciate that embodiments of the present invention could be configured in numerous shapes and usable with ID cards of any shape and size. Embodiments of the present invention are contemplated for use with ID cards of any shape and size.

Additionally, while the figures of this application and much of the description of this application reference ID cards, embodiments of the present invention could be utilized with cards or devices of any character. For instance, embodiments of the present invention could be utilized with hotel room keys, security badges, terminal access cards, membership cards, credit cards, debit cards and/or other purchasing cards. One of ordinary skill in the art would appreciate that there are numerous types of cards that could be utilized with embodiments of the present invention, and embodiments of the present invention are contemplated for use with any type of card.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. An ID card holder configured to retain an identification card, said ID card holder comprising:

a rectangular inner tray comprising a floor, a peripheral wall having a curved outer side and an inner side that defines a continuous channel, wherein said wall extends along the entire length of three contiguous sides of said tray, wherein said channel and floor define a slot configured to receive a portion of an identification card, and a first connection means in the form of a circular projection centrally disposed on the undersurface of said inner tray; and a complementary outer tray dimensioned to receive said inner tray to form a snug fit therebetween, said outer tray comprising an interior floor that is substantially uncovered and a peripheral wall extending the length of three contiguous sides of said tray, said wall having a convex outer side, and a concave inner side which faces said floor said concave inner side of said wall defines a channel, wherein said channel and said floor define a slot configured to receive said first tray, wherein a circular aperture in said floor defines a second connection means configured to engage said first connection means of said inner tray, wherein said identification card is secured in said channel of said inner tray when said inner tray is received in said outer tray, and wherein when said inner tray is inserted in said outer tray, said first connection means engages with said second connection means to form a releasable lock to hold said inner and outer trays together.

2. The ID card holder of claim 1, wherein a sufficient section of said identification card is permanently uncovered to allow an uncovered readable component of said identification card to be read while said identification card is retained in said ID card holder.

3. The ID card holder of claim 2, wherein said permanently uncovered section of said identification card may be swiped, scanned or inserted in an identification card reader.

4. The ID holder of claim 1, wherein said outer tray further comprises a wearable attachment component attachment means in the form of a cylinder defining a through bore through which a line may be threaded, wherein said attachment component attachment means is disposed in a central recess in a side of said outer tray.

5. The ID holder of claim 4, wherein said wearable component is one or more of a necklace, a bracelet, a lanyard, a retractable cord, a belt clip and a wallet clip.

6. The ID holder of claim 1, wherein said ID card holder is comprised of one or more materials consisting of rubber, plastic, metal, ceramics and silicone.

7. The ID holder of claim 1, wherein said identification card is secured in said slot of said inner tray by way of a friction fit.

8. The ID holder of claim 1, wherein said first connection means is a tab lock and said second connection means is a matching tab lock.

9. The ID holder of claim 1, wherein said first connection means and second connection means secure together in a friction fit.

10. The ID holder of claim 1, wherein said first connection means and second connection means secure together in a spring biased tension lock.

11. The ID holder of claim 1, wherein said first connection means and said second connection means are complementary.

* * * * *